US008800188B1

(12) United States Patent
Fishelis

(10) Patent No.: US 8,800,188 B1
(45) Date of Patent: Aug. 12, 2014

(54) PICTURE FRAME TRAY SYSTEM

(71) Applicant: Aaron Fishelis, Lakewood, NJ (US)

(72) Inventor: Aaron Fishelis, Lakewood, NJ (US)

( * ) Notice: Subject to any disclaimer, the term of this patent is extended or adjusted under 35 U.S.C. 154(b) by 26 days.

(21) Appl. No.: 13/709,090

(22) Filed: Dec. 10, 2012

Related U.S. Application Data

(60) Provisional application No. 61/569,663, filed on Dec. 12, 2011.

(51) Int. Cl.
*A47G 1/16* (2006.01)

(52) U.S. Cl.
CPC ..... *A47G 1/16* (2013.01); *A47G 1/1613* (2013.01)
USPC ..... 40/711

(58) Field of Classification Search
USPC ..... 40/711, 725, 727, 753, 777; 312/33
See application file for complete search history.

(56) References Cited

U.S. PATENT DOCUMENTS

| | | | | |
|---|---|---|---|---|
| 279,290 | A * | 6/1883 | Von der Wulbeke | 108/48 |
| 1,450,148 | A * | 3/1923 | Erkenswick | 312/33 |
| 5,219,630 | A * | 6/1993 | Hickman | 428/38 |
| 5,659,991 | A * | 8/1997 | Kennedy | 40/729 |
| 5,826,851 | A * | 10/1998 | Arbisi | 248/466 |
| 6,308,641 | B1 * | 10/2001 | Kingbury | 108/42 |
| 6,817,125 | B2 * | 11/2004 | Chatterjea | 40/611.02 |
| 7,231,736 | B2 * | 6/2007 | Labin | 40/725 |
| 7,481,014 | B2 * | 1/2009 | Milburn | 40/724 |
| 7,815,263 | B1 * | 10/2010 | Wright | 312/204 |
| 8,381,661 | B2 * | 2/2013 | Hilde | 108/42 |
| 2006/0143965 | A1 * | 7/2006 | Labin | 40/725 |
| 2010/0011645 | A1 * | 1/2010 | Milburn-Hall | 40/724 |

* cited by examiner

*Primary Examiner* — Joanne Silbermann
*Assistant Examiner* — Christopher E Veraa
(74) *Attorney, Agent, or Firm* — Emery L. Tracy; Ruth Eure

(57) ABSTRACT

A picture frame tray system for supporting at least one object adjacent a wall is provided. The picture tray system comprises a picture frame having a front side, a rear side substantially opposite the front side, a top edge, a bottom edge substantially opposite the top edge, and a pair of side edges between the top edge and the bottom edge. At least one image positioned on the front side of the picture frame. At least one hinge mechanism is secured between the bottom edge of the picture frame and the wall. The at least one hinge mechanism allows the picture frame to move between a displaying position with the top edge of the picture frame adjacent the wall and the image facing away from the wall and a tray position with the top edge of the picture frame distant from the wall.

17 Claims, 2 Drawing Sheets

PICTURE FRAME TRAY SYSTEM

The present application claims the benefit of priority of provisional patent application Ser. No. 61/569,663, filed on Dec. 12, 2011, entitled "Picture Frame That Drops Down Into a Tray".

BACKGROUND OF THE INVENTION

1. Field of the Invention

This invention relates generally to picture frame tray system and, more particularly, the invention relates to a picture frame tray system providing a picture frame that rotates away from the wall forming a tray for supporting Shabbos candles and other objects including food and drinks, electronics, and the like.

2. Description of the Prior Art

Shabbat (Hebrew: שקת , "rest" or "cessation") or Shabbos (Yiddish:שאתעס ) is the Jewish day of rest and seventh day of the week, on which they remember the traditional creation of the heavens and the earth in six days and the Exodus of the Hebrews, and look forward to a future Messianic Age. Shabbat observance entails refraining from work activities, often with great rigor, and engaging in restful activities to honor the day. The longstanding traditional Jewish position is that unbroken seventh-day Shabbat originated among the Jewish people, as their first and most sacred institution, though some suggest an obscure later, naturalistic origin. Variations upon Shabbat are widespread in Judaism and, with adaptations, throughout the Abrahamic and many other religions.

According to Halakha, Shabbat is observed from a few minutes before sunset on Friday evening until the appearance of three stars in the sky on Saturday night. Shabbat is ushered in by lighting candles and reciting a blessing. Traditionally, three festive meals are eaten: in the evening, in the morning, and late in the afternoon. The evening dinner typically begins with kiddush and another blessing recited over two loaves of challah. Shabbat is closed the following evening with a havdalah blessing. Shabbat is a festive day when Jewish people exercise their freedom from the regular labors of everyday life. It offers an opportunity to contemplate the spiritual aspects of life and to spend time with family.

Many times, finding space for properly observing Shabbat can be challenging. For instance, it may be difficult to find a safe and proper place to position the candles prior to lighting. If there are small children present or there is not a convenient horizontal surface, the candles would have to positioned in an inappropriate place and could become disturbed and cause fire damage. It would be beneficial to have a proper place for the candles used in observing Shabbat.

SUMMARY

The present invention is a picture frame tray system for supporting at least one object adjacent a wall. The picture tray system comprises a picture frame having a front side, a rear side substantially opposite the front side, a top edge, a bottom edge substantially opposite the top edge, and a pair of side edges between the top edge and the bottom edge. At least one image positioned on the front side of the picture frame. At least one hinge mechanism is secured between the bottom edge of the picture frame and the wall. The at least one hinge mechanism allows the picture frame to move between a displaying position with the top edge of the picture frame adjacent the wall and the image facing away from the wall and a tray position with the top edge of the picture frame distant from the wall.

In addition, the present invention includes a picture frame tray system for supporting at least one object adjacent a wall. The picture tray system comprises a picture frame having a front side, a rear side substantially opposite the front side, a top edge, a bottom edge substantially opposite the top edge, and a pair of side edges between the top edge and the bottom edge. At least one image is positioned on the front side of the picture frame. At least one hinge mechanism is secured between the bottom edge of the picture frame and the wall. A metal material is secured to the back side of the picture frame along the top edge of the picture frame. A corresponding magnet is secured to the wall such that when the picture frame is rotated upward from the tray position to the displaying position, the metal material contacts the magnet thereby releasably securing the picture frame against the wall. At least one length of material extends between the wall and the rear side of the picture frame. The picture frame is moveable between a displaying position with the top edge of the picture frame releasably secured adjacent the wall and the image facing away from the wall and a tray position with the at least one length of material stopping the picture frame in a substantially horizontal position substantially perpendicular to the wall and the top edge of the picture frame distant from the wall.

DETAILED DESCRIPTION OF THE PREFERRED EMBODIMENTS

Figure 1:
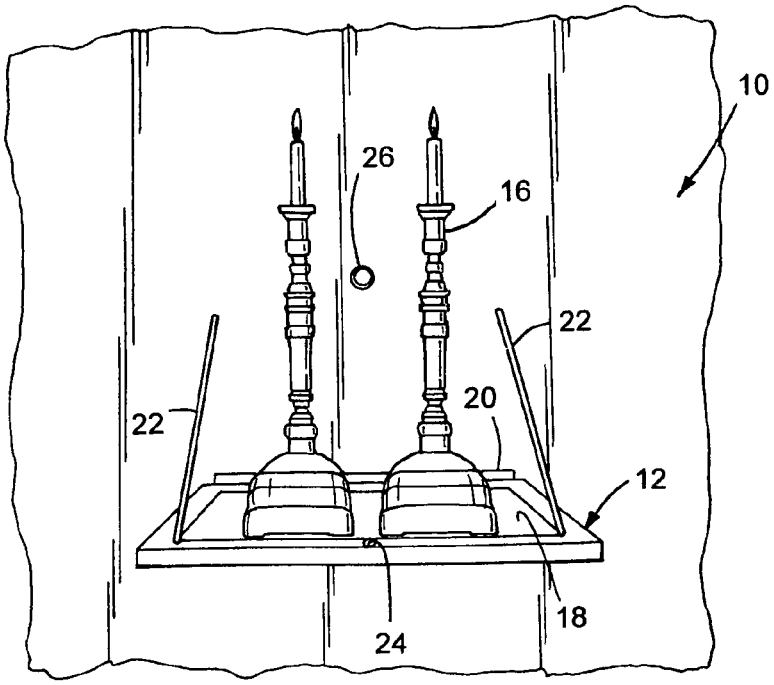
FIG. 1 is a perspective view illustrating a picture frame tray system, constructed in accordance with the present invention, with a picture frame folded down away from a wall into a tray position.
Figure 2:
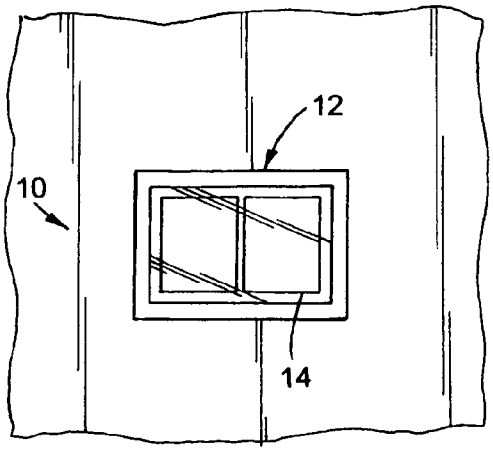
FIG. 2 is a front elevational view illustrating an embodiment of the picture frame tray system, constructed in accordance with the present invention, with the picture frame folded up against the wall and displaying a pair of images.
Figure 3:
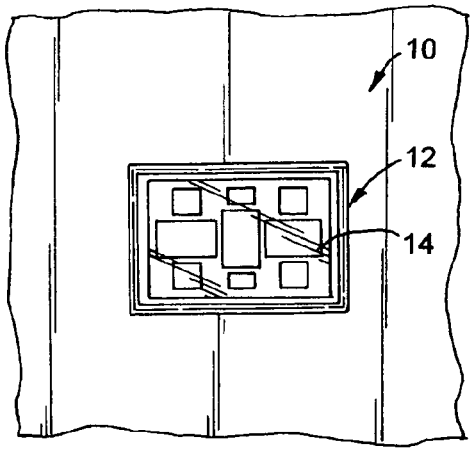
FIG. 3 is a front elevational view illustrating another embodiment of the picture frame tray system, constructed in accordance with the present invention, with the picture frame folded up against the wall and displaying a plurality of images.
Figure 4:
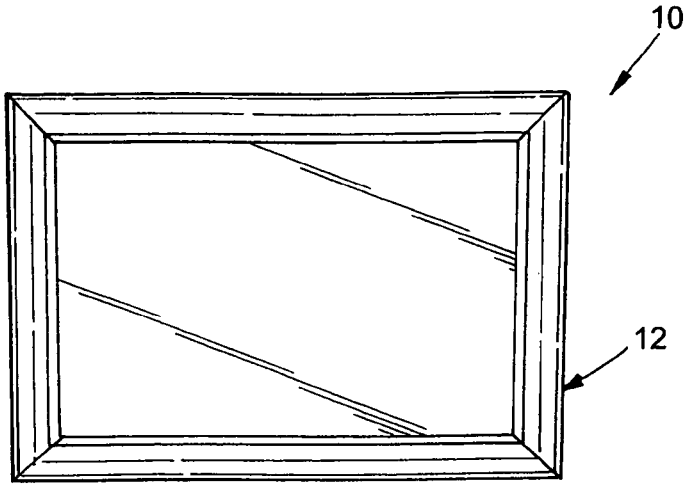
FIG. 4 is a front elevational view illustrating a gold frame of the picture frame tray system, constructed in accordance with the present invention.
Figure 5:
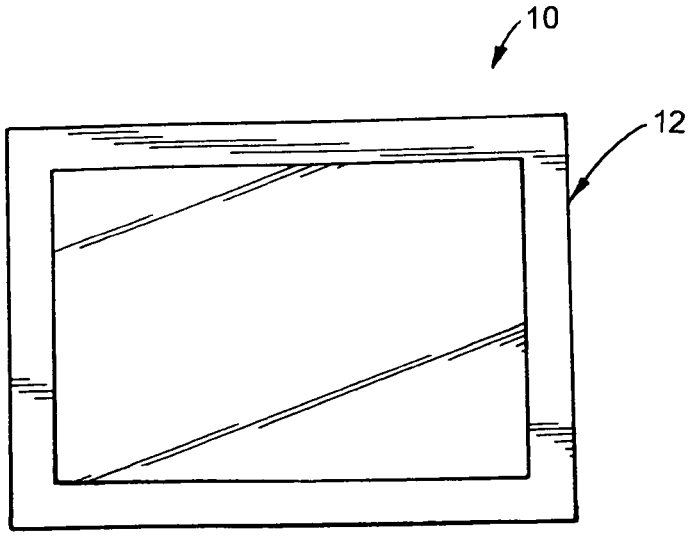
FIG. 5 is a front elevational view illustrating a cherry frame of the picture frame tray system, constructed in accordance with the present invention.

As illustrated in FIGS. 1-5, the present invention is a picture frame tray system, indicated generally at 10, providing a picture frame 12 in a display position on a wall that rotates away from the wall to a tray position forming a tray for supporting Shabbos candles and other objects including food and drinks, electronics, and the like.

The picture frame tray system 10 of the present invention includes the picture frame 12 having a front side, a rear side substantially opposite the front side, a top edge, a bottom edge substantially opposite the top edge, and a pair of side edges between the top edge and the bottom edge. The picture frame 12 can be constructed from a wood material with a stain or paint covering or the picture frame 12 can be constructed from another rigid material including, but not limited to, metal, ceramic, etc.

The front side of the picture frame 12 of the picture frame tray system 10 of the present invention can display one or more images 14 such as photographs or prints, mirrors, and/or paintings. In a preferred embodiment, the picture frame 12 has a length of approximately eighteen (18") inches and a width of approximately twelve (12") inches although having a picture frame 12 with different dimensions is within the scope of the present invention. With the preferred dimensions of the picture frame 12, the front side of the picture frame 12 also preferably has two different matting choices with the first choice being two eight (8") inch by ten (10") openings and the second choice being nine (9) various sized openings. Clear glass can be provided to cover the images 14, if desired by the user.

The rear side of the picture frame 12 of the picture frame tray system 10 is constructed of a flat, smooth, rigid material allowing the rear side to support a pair of candles 16 or the like. In a preferred embodiment, the rear side of the picture frame 12 can be covered in a fire resistant, mirror glass material 18 or a hard plastic or metal material that snaps into the picture frame 12, both of which can be removed for easy cleaning. The mirror glass material 18 and the plastic or metal material assists in preventing fires. Also, the perimeter of the picture frame 12 can extend above the rear side to inhibit the candles from inadvertently sliding off the rear side of the picture frame 12.

The picture frame 12 of the picture frame tray system 10 is rotatably mounted to the wall by at least one hinge mechanism 20 secured between the bottom edge of the picture frame 12 and the wall. The hinge mechanism 20 allows the picture frame 12 to move between a displaying position with the top edge of the picture frame 12 adjacent the wall and a tray position with the top edge of the picture frame 12 distant from the wall. In a preferred embodiment, the hinge mechanism 20 is a piano-type hinge although using other types of hinge mechanisms 20 is within the scope of the present invention.

The picture frame tray system 10 of the present invention further includes at least one length of material 22 extending between the wall and the rear side of the picture frame 12. The at least one length of material 22 allows the picture frame 12 to stop in a substantially horizontal position substantially perpendicular to the wall. In a preferred embodiment, the picture frame tray system 10 includes two lengths of material 22 extending between each side edge of the picture frame 12 and the wall. In addition, in a preferred embodiment, the lengths of material 22 are ball chains allowing the picture frame 12, in the tray position, to support increased weight although other types of material 22 including, but not limited to other types of chains, are within the scope of the present invention.

In order to releasably secure the picture frame 12 of the picture frame tray system 10 of the present invention in the displaying position against the wall, a metal material 24 is secured to the back side of the picture frame 12 along the top edge of the picture frame. A corresponding magnet 26 is secured to the wall such that when the picture frame 12 is rotated upward from the tray position to the displaying position, the metal material 24 contacts the magnet 26 thereby releasably securing the picture frame 12 in the displaying position. A gentle tug at the top edge of the picture frame 12 releases the metal material from the magnet 26 allowing the picture frame 12 to rotate via the hinge mechanism 20 until the extent of the length of material 22 stops the picture frame 12 in the substantially horizontal tray position.

Basically, the picture tray system 10 of the present invention serves as a picture frame 12 for displaying desired images 14 during the week and flips down into a mirrored tray for Shabbos candles 16 and other objects, when desired. Innovative, beautiful, convenient, and space saving, the picture tray system 10 saves valuable space in the dining room while providing sought-after peace of mind for parents in regard to the inherent potential of danger involved in having flickering Shabbos candles 16 and other objects on the table. With a simple tug of the hand, the decorative picture frame 12 evident during the week becomes an instant wall shelf for the leichter upon with the arrival of Shabbos high above the accessibility of little hands.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein may be suitably practiced in the absence of the specific elements which are disclosed herein.

What is claimed is:

1. A picture frame tray system for supporting at least one object adjacent a wall, the picture tray system comprising;

a picture frame having a front side, a rear side substantially opposite the front side, a top edge, a bottom edge substantially opposite the top edge, and a pair of side edges between the top edge and the bottom edge, the rear side being constructed of a flat, smooth, rigid material, the rigid material being a fire resistant, mirror glass material;

at least one image positioned on the front side of the picture frame; and at least one hinge mechanism secured between the bottom edge of the picture frame and the wall;

wherein the at least one hinge mechanism allowing the picture frame to move between a displaying position with the top edge of the picture frame adjacent the wall and the image facing away from the wall and a tray position with the top edge of the picture frame distant from the wall.

2. The picture frame tray system of claim 1 wherein the picture frame is a material selected from the group consisting of a wood material with a stain or paint covering and a metal material.

3. The picture frame tray system of claim 1 wherein the front side of the picture frame has two different matting choices with the first choice being two eight (8") inch by ten (10") openings and the second choice being nine (9) various sized openings.

4. The picture frame tray system of claim 1 and further comprising:

clear glass positioned over the at least one image.

5. The picture frame tray system of claim 1 wherein a perimeter of the picture frame on the rear side extends above the rear side.

6. The picture frame tray system of claim 1 wherein the at least one hinge mechanism is a piano-type hinge.

7. The picture frame tray system of claim 1 and further comprising:

at least one length of material extending between the wall and the rear side of the picture frame, the at least one length of material stopping the picture frame in a substantially horizontal position substantially perpendicular to the wall.

8. The picture frame tray system of claim 7 and further comprising:

two lengths of material a length of material extending between each side edge and the wall;

wherein the lengths of material are ball chains.

9. The picture frame system of claim 1 and further comprising:

a metal material secured to the back side of the picture frame along the top edge of the picture frame; and a corresponding magnet secured to the wall such that when the picture frame is rotated upward from the tray position to the displaying position, the metal material contacts the magnet thereby releasably securing the picture frame in the displaying position.

10. A picture frame tray system for supporting at least one object adjacent a wall, the picture tray system comprising;

a picture frame having a front side, a rear side substantially opposite the front side, a top edge, a bottom edge substantially opposite the top edge, and a pair of side edges between the top edge and the bottom edge, the rear side of the picture frame being a fire resistant, mirror glass material;

at least one image positioned on the front side of the picture frame;

at least one hinge mechanism secured between the bottom edge of the picture frame and the wall;

a metal material secured to the back side of the picture frame along the top edge of the picture frame;

a corresponding magnet secured to the wall such that when the picture frame is rotated upward from the tray position to the displaying position, the metal material contacts the magnet thereby releasably securing the picture frame against the wall; and at least one length of material extending between the wall and the rear side of the picture frame;

wherein the picture frame is moveable between a displaying position with the top edge of the picture frame releasably secured adjacent the wall and the image facing away from the wall and a tray position with the at least one length of material stopping the picture frame in a substantially horizontal position substantially perpendicular to the wall and the top edge of the picture frame distant from the wall.

11. The picture frame tray system of claim 10 wherein the picture frame is a material selected from the group consisting of a wood material with a stain or paint covering and a metal material.

12. The picture frame tray system of claim 10 wherein the front side of the picture frame has two different matting choices with the first choice being two eight (8") inch by ten (10") openings and the second choice being nine (9) various sized openings.

13. The picture frame tray system of claim 10 and further comprising:

clear glass positioned over the at least one image.

14. The picture frame tray system of claim 10 wherein the object is Shabbos candles.

15. The picture frame tray system of claim 10 wherein a perimeter of the picture frame on the rear side extends above the rear side.

16. The picture frame tray system of claim 10 wherein the at least one hinge mechanism is a piano-type hinge.

17. The picture frame tray system of claim 10 and further comprising:

two lengths of material a length of material extending between each side edge and the wall;

wherein the lengths of material are ball chains.

* * * * *